US005107222A

United States Patent [19]

Tsuzuki

[11] Patent Number: 5,107,222

[45] Date of Patent: Apr. 21, 1992

[54] CONTROL DEVICE FOR PARTICLE ACCELERATOR

[75] Inventor: Naohisa Tsuzuki, Chofu, Japan

[73] Assignee: Kabushiki Kaisha Toshiba, Kawasaki, Japan

[21] Appl. No.: 564,856

[22] Filed: Aug. 9, 1990

[30] Foreign Application Priority Data

Aug. 22, 1989 [JP] Japan ..... 1-214051

[51] Int. Cl.[5] ..... H05H 7/02

[52] U.S. Cl. ..... 328/233; 315/5.41

[58] Field of Search ..... 328/233; 315/5.41, 5.42, 315/111.61, 359.1; 307/219, 441; 364/525

[56] References Cited

FOREIGN PATENT DOCUMENTS 0314799 12/1988 Japan ..... 328/233

OTHER PUBLICATIONS

M. Clinnick, et al., "Digital Controlled Frequency for Synchrotron Acceleration", IEEE Transactions on Nuclear Science, vol. NS-22, No. 3, Jun., 1975, pp. 1261-1264.

*Primary Examiner*—Donald J. Yusko
*Assistant Examiner*—Nimeshkumar D. Patel
*Attorney, Agent, or Firm*—Foley & Lardner

[57] ABSTRACT

A plural of memories for storing a variation of current flowing through a particle accelerator coil over one period of operation as an operation pattern are provided, to which clock pulses are supplied cylically with the above period as a unit to read the operation pattern in synchronism with the clock pulses to thereby control the accelerator coil current. A rewriting of operation pattern to be stored in the respective memories is performed in a period during which the clock pulses are not supplied.

6 Claims, 6 Drawing Sheets

CONTROL DEVICE FOR PARTICLE ACCELERATOR

FIELD OF THE INVENTION

The present invention relates to a control device for an accelerator for obtaining high energy charged particles and, particularly, to a control device for a particle accelerator suitable to output, in real time, an operational pattern signals to be supplied to power sources of an electromagnet coils and electromagnetic wave power generator which are main constitutional components of the accelerator.

BACKGROUND OF THE INVENTION

Heretofore, a particle accelerator such as a synchrotron or a cyclotron which accelerates charged particles such as electrons, protons, ions and the like to high energy has been widely known, and recently the application thereof is expanding into other fields such as minute working of semiconductor and medical treatment of cancer.

In a case of a synchrotron accelerator, a track for the charged particles is constructed in the form of a vacuum duct. A plurality of electromagnets are provided along the track to deflect the particles. A device for generating a high-frequency electromagnetic wave is also provided along the track. In the initial stage of the operation, charged particles are supplied to the accelerator at a comparatively low energy, and accelerated by the application of the electromagnetic wave according to a predetermined pattern. In order to deflect the accelerated particles along the track, the current flowing through each electromagnet is varied according to the energy of the particles imparted by the acceleration. When the particles are accelerated to an objective energy, the particles are held in this state for a predetermined time, and then extracted from the accelerator. In order to realize the above current pattern, the control device of a accelerator is equipped with memory devices for generating such patterned signals as mentioned above for the power source of the electromagnet coils and the electromagnetic wave power generator (referred to as an RF hereinafter).

FIGS. 1 and 2 show an example of a conventional particle accelerator control device having such a memory device.

In FIG. 1, the control device 1 comprises a control computer 2, a pulse generator 3 and a memory device 4 whose output signal DO is sent to a power source 5. The power source 5 supplies current I controlled by the output signal DO to an electromagnet coil K of the particle accelerator.

A reference signal of current I flowing through the electromagnet coil K, that is, an objective value, is provided by the memory device 4 as a digital output signal DO. The memory device 4 stores a variation of the current reference signal with time, that is, a running pattern, and reads out a memory content of 1 word for each clock pulse CP produced by the pulse generator 3 and outputs it as the digital output signal DO. A read address of the memory device 4 is increased by an amount corresponding to 1 word for each clock pulse CP. Furthermore, the running pattern stored in the memory device 4 is preliminarily written by the control computer 2 through a data bus 6. Furthermore, the control computer 2 provides a start/stop signal ST to the pulse generator 3 to control a start and stop of generation of clock pulse CP.

FIG. 2 illustrates an operation of the memory device 4. Every time the clock pulse CP is input, an address counter 41 is increased by 1 address and data in this address is read out from a memory 42 and set in an output register 43. The data set in the output register 43 is output as the digital output signal DO.

The data stored in the memory 42 has been written in by the control computer 2 connected to the data bus 6, before the operation begins.

FIG. 3 is a time chart showing a typical operation of the above mentioned device. As shown in this figure, when the start/stop signal ST from the control computer 2 becomes ON, the pulse generator 3 outputs the clock pulse CP continuously. With this clock pulse CP, the memory device 4 starts to output a data having a pattern which becomes the digital output signal DO. A rise portion of the digital output signal DO corresponds to an increase of particle energy during which injected particles of low energy are accelerated to a predetermined high energy state. When it reaches the predetermined energy level, the digital output signal DO becomes a constant value during which the particle is extracted and used according to the object of the accelerator. Thereafter, the start/stop signal ST becomes OFF and the pulse train of the clock pulse CP is stopped, so that the digital output signal DO becomes zero. With this, the current I attenuates with a time constant of a closed circuit formed between the electromagnet coil K and the power source 5. The above operation is usually repeated, which is referred to as "periodic operation", hereinafter.

In this case, operation patterns of sufficiently high precision are required to be stored in the memory device 4 for obtaining a sufficient amount of the extracted particles. That is, when the particles are accelerated according to an operation pattern adjusted insufficiently, the particles tend to be deviated from the predetermined path, and therefore the amount of the highly energized particles extracted from the accelerator is reduced. In order to overcome this difficulty, it is required that the clock pulses CP generated from the pulse generator 3 are set at a high frequency, and the number of data words used for defining the operation pattern must be increased sufficiently. For instance, several hundred kilowords are sometimes required for forming one operation pattern.

Theoretically, the aforementioned operation pattern may be predetermined at a desired extent of precision. However, in a practical case, the pattern tends to deviate from the theoretical value according to the actual condition of the electromagnets and the related circuits. Accordingly, in a conventional accelerator, the required amount of charged particles have been obtained from the accelerator in a manner such that the intensity of the beam of the charged particles is constantly evaluated, and the contents of the memory device storing the operation pattern are rewritten on the basis of the evaluated results.

Furthermore, in a system utilizing the highly energized particles extracted from the accelerator, it is urgently required that the charged particles are obtained in a short period (for instance 1~2 sec.). However, since a considerable time is required in rewriting the contents of the memory device storing a large amount of data as described above, it is made essential to interrupt the cyclic operation of the accelerator for a predetermined time. Thus, it is impossible to regulate current rapidly and with high accuracy, resulting in a lowered operation efficiency of the accelerator.

SUMMARY OF THE INVENTION

In view of the above, an object of the present invention is to provide a control device of a particle accelerator, which can regulate current rapidly and with high accuracy and without stopping the periodic operation and thus enabling a high efficiency operation.

In order to achieve the above object, a control device of a particle accelerator according to the present invention comprises a power source for supplying current to a particle accelerator coil, a pulse generator for generating clock pulses, a plurality of memory means for storing time variation of current flowing through the particle accelerator coil as an operation pattern, a means for reading the operation pattern stored in the selected one of the plurality of memory means synchronized with the clock pulses from the pulse generator, an output circuit for supplying the operation pattern read out by the reading means to the power source, and a means for rewriting an operation pattern to be stored in the memory means to which no clock pulses are supplied while the operation pattern in the selected memory means is being read out.

Thus, the memory content is read out from a certain (first) memory means in synchronism with the clock pulses, and provided as the digital signal. During this period, since the other memory means have no clock pulses input to them and are inoperative, they can perform rewriting of their memory contents.

Similarly, when the content of second memory means is read out synchronous with the clock pulses and the digital signal is provided thereby, the remaining memory means have no clock pulse input and thus are inoperative. Therefore, rewriting of their memory contents can be performed.

Thus, according to the present invention, it becomes possible to rewrite the memory contents from which the operation pattern is given and to perform the operation according to the rewritten memory contents immediately after rewriting. Therefore, it is possible to perform the regulation necessary to start the operation of the accelerator, that is, operations for setting values of energy and/or current value of charged particle to predetermined values, rapidly without interrupting the periodic operation.

DETAILED DESCRIPTION OF THE PREFERRED EMBODIMENTS

Figure 1:
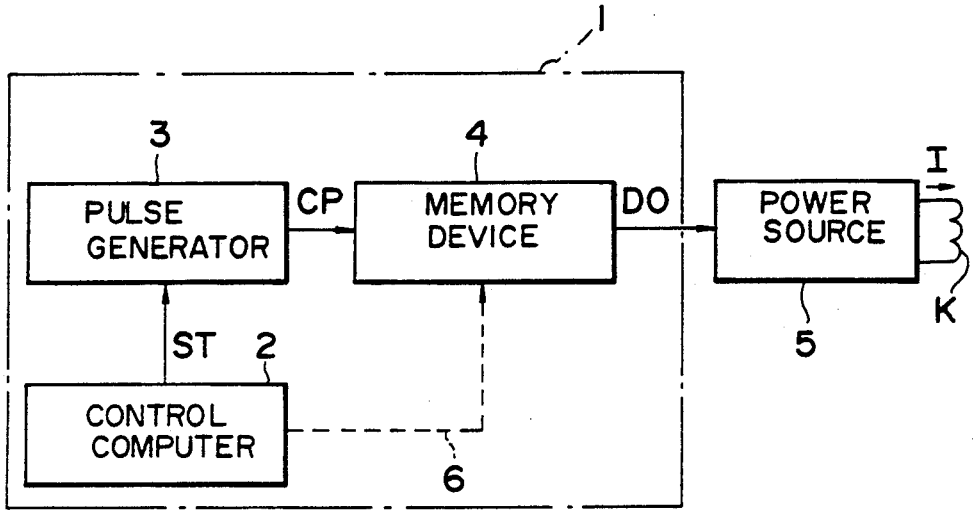
FIG. 1 PRIOR ART
FIG. 1 is a block diagram of a conventional particle accelerator control device.
Figure 2:
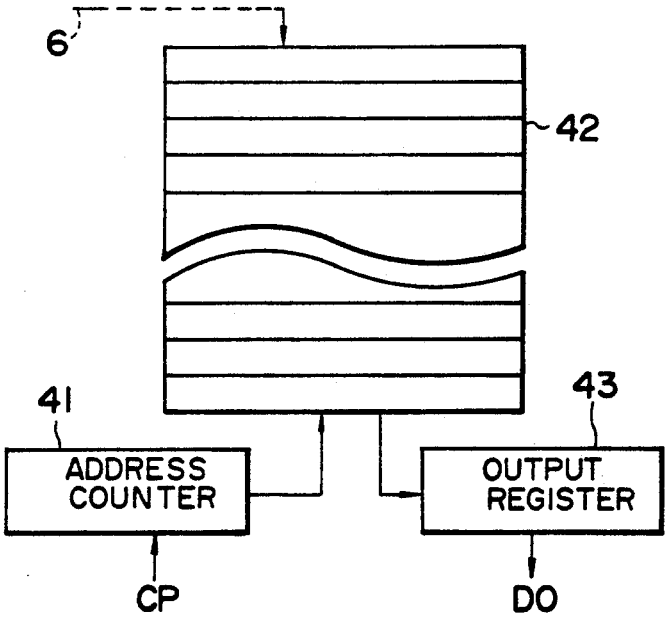
FIG. 2 PRIOR ART
FIG. 2 shows a construction of a memory device in the device shown in FIG. 1.
Figure 3:
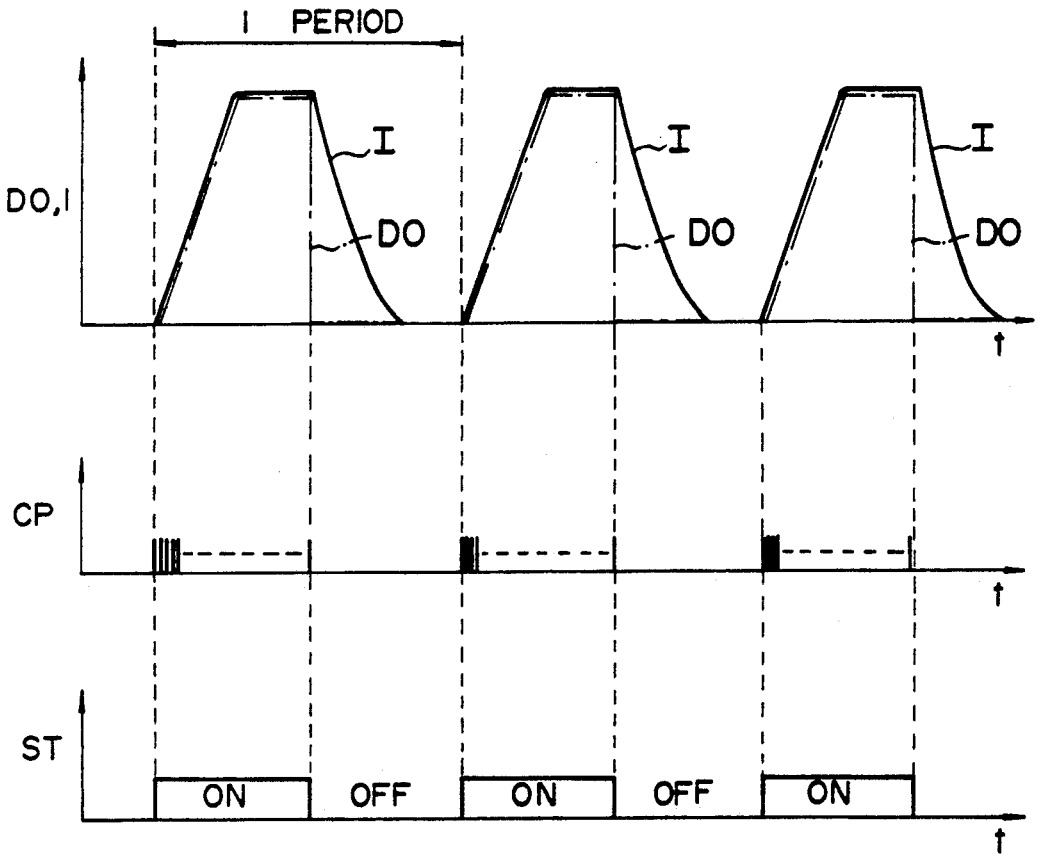
FIG. 3 PRIOR ART
FIG. 3 is a time chart of signals at respective portions of the device shown in FIG. 1 for explanation of operation thereof.
Figure 4:
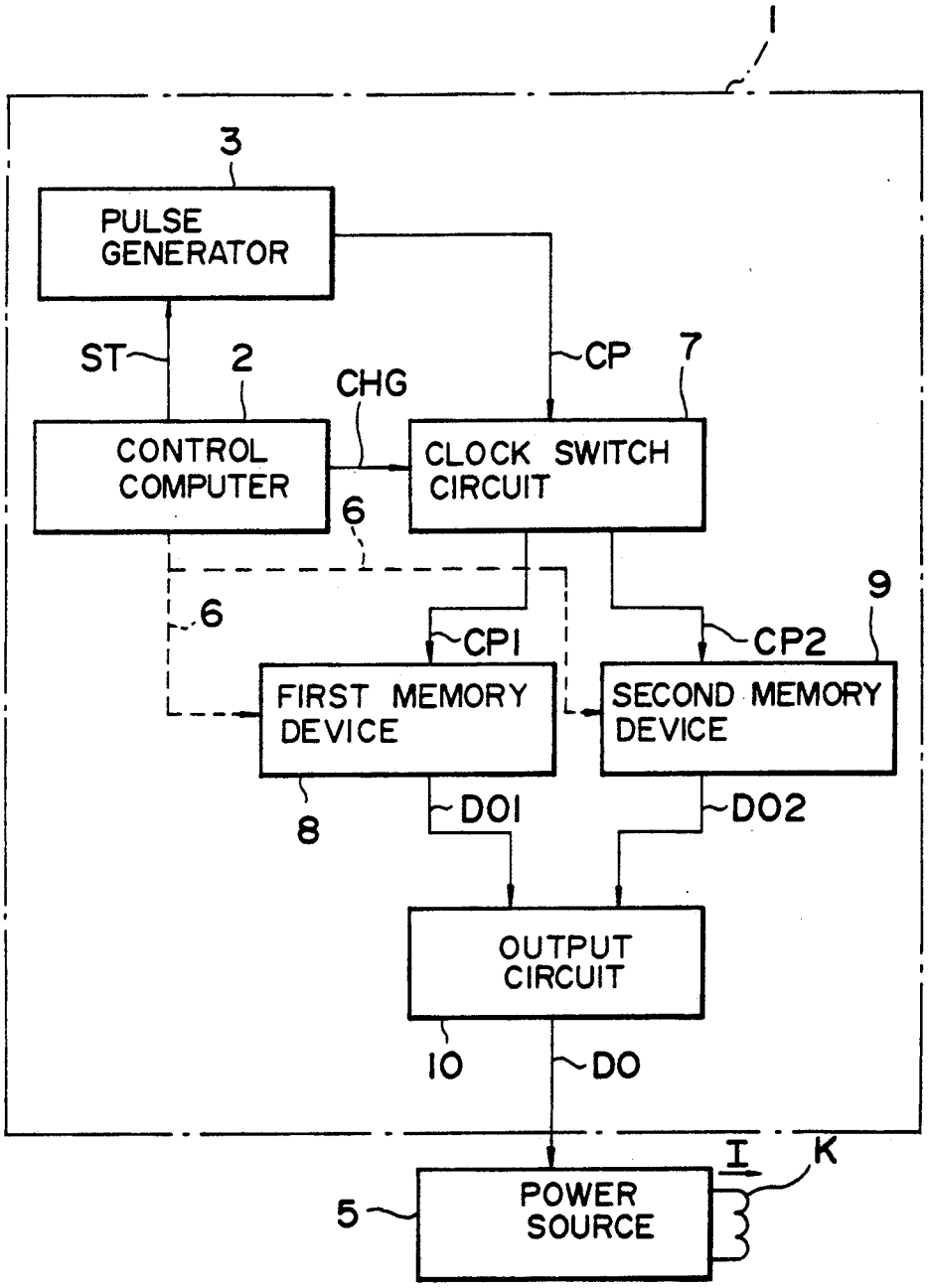
FIG. 4 is a block diagram of a particle accelerator control device according to the present invention.

FIG. 4 is a block diagram of a particle accelerator control device according to an embodiment of the present invention. In FIG. 4, same reference numerals as those used in FIG. 1 depict the same or corresponding portions, respectively. A control device 1 is composed of a control computer 2, a pulse generator 3, a clock switch circuit 7, a first memory device 8, a second memory device 9 and an output circuit 10, a digital output DO which is sent to a power source 5.

The pulse generator 3 generates clock pulses CP to be supplied to the clock switch circuit 7. The continuous generation of clock pulses CP of the pulse generator 3 is started or stopped upon an ON or OFF of a start/stop signal ST supplied from the control computer 2.

A memory selection signal CHG is supplied to the clock switch circuit 7 by the computer 2, upon which the clock switch circuit 7 supplies clock pulse CP received thereby to the first memory device 8 as a first clock signal CP1 or to the second memory device 9 as a second clock signal CP2.

The first memory device 8 responds to the clock signal CP1 to output a digital signal DO1 stored therein. Similarly, the second memory device 9 responds to the clock signal CP2 to output a digital signal DO2 stored therein.

The digital signals DO1 and DO2 are supplied to the output circuit 10 from which either the signal DO1 or DO2 is output as an output signal DO which is supplied to the power source 5 as a reference value of current I.

Figure 5:
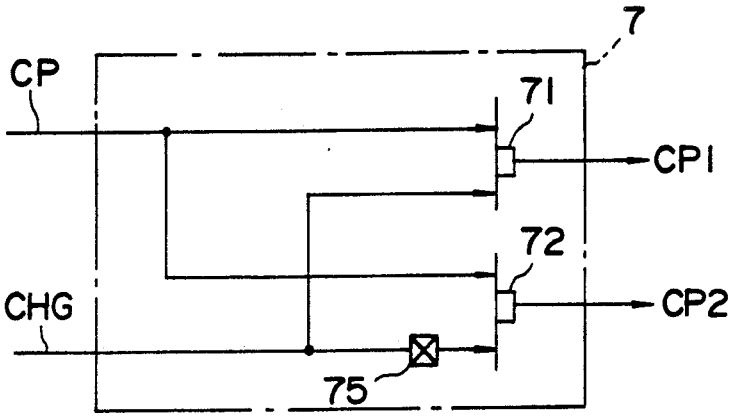
FIG. 5 shows a clock switch circuit in the device shown in FIG. 4 in detail.

FIG. 5 shows the clock switch circuit 7 in detail. The clock pulses CP is supplied to one input of logical product elements 71 and 72. The memory selection signal CHG is supplied to the other input of the logical product element 71 and to the other input of the logical product element 72 through an inversion circuit 75. An output of the logical product element 71 is used as the first clock signal CP1 to be supplied to the first memory device 8 and an output of the second logical product element 72 is used as the second clock signal CP2 to be supplied to the second memory device 9.

Figure 6:
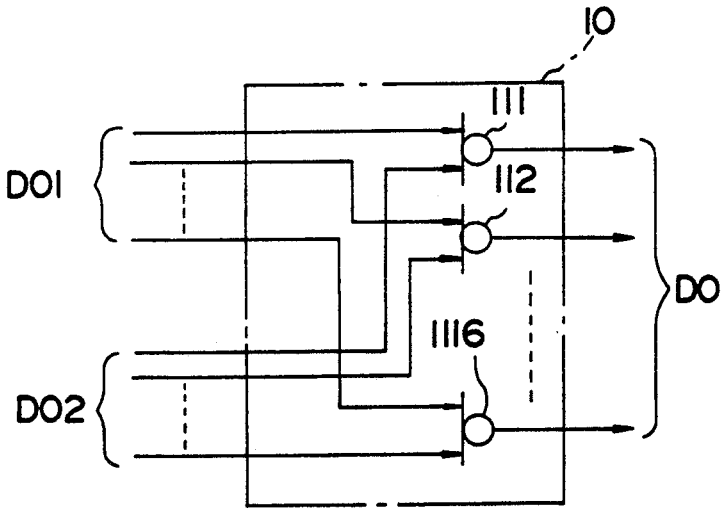
FIG. 6 shows an OR circuit in the device shown in FIG. 4 in detail.

FIG. 6 shows the output circuit 10 in detail. The output circuit 10 in this embodiment is constituted with logical sum circuits and digital signals DO1 and DO2 are input as parallel signals each having 16 bits. These signals are input to logical sum elements 111, 112, . . . , 1116 for every bit signals of the digital signals DO1 and DO2 so that a parallel digital output signal DO of 16 bits is output.

Figure 7:
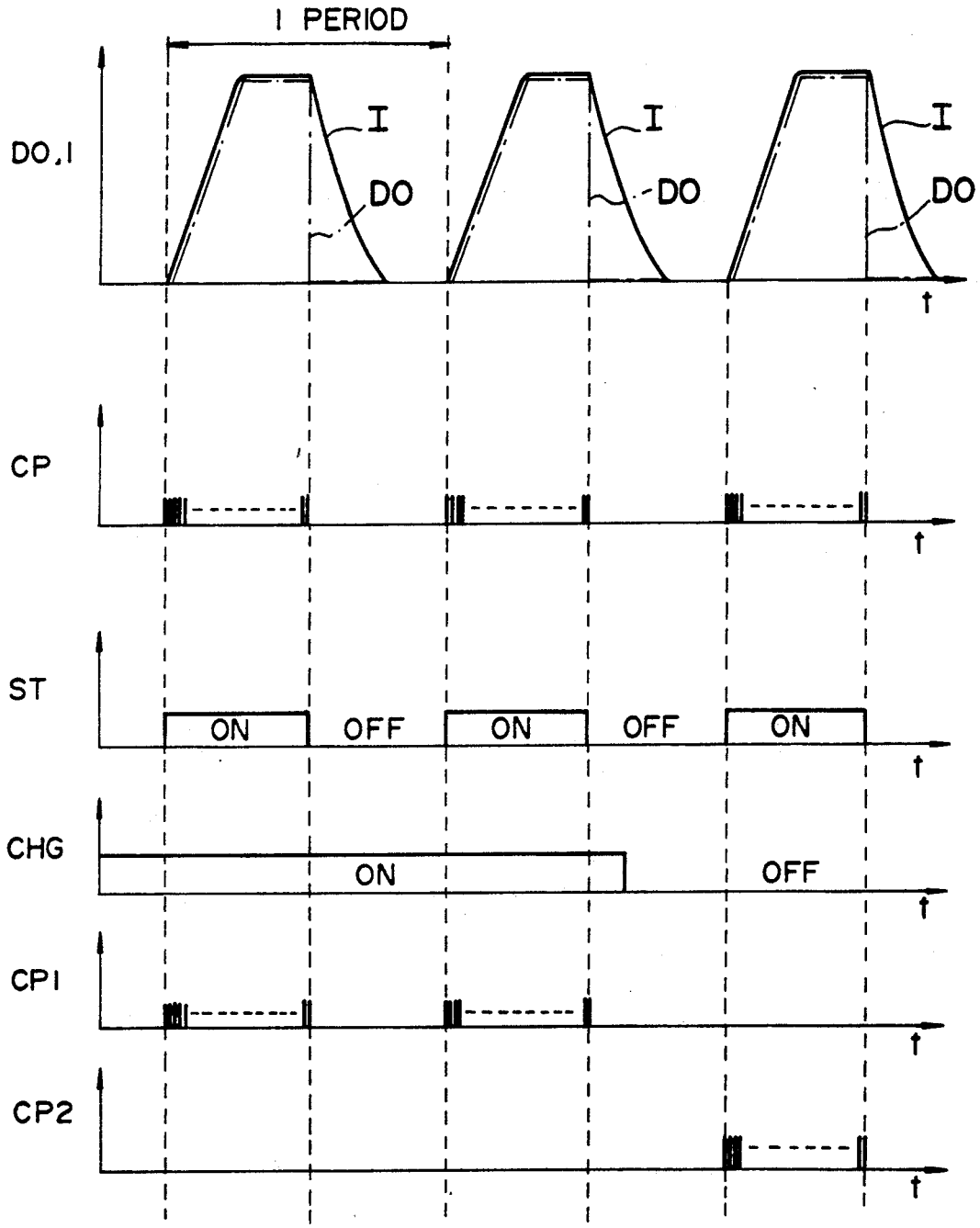
FIG. 7 is a time chart of signals at various portions of the device shown in FIG. 4 for explanation of operation thereof.

In operation, when the start/stop signal ST becomes ON, the pulse generator 3 produces clock pulses CP, as shown in a time chart in FIG. 7. In the clock switch circuit 7, clock pulses CP is output as clock signal CP1 during a time in which the memory selection signal CHG is ON, as shown in FIG. 5. In this case, clock signal CP2 is not output.

Therefore, only the first memory device 8 is operated by the clock signal CP1 to provide a digital signal DO1. The digital signal DO1 is output through the output circuit 10 as the digital output signal DO which is supplied to the power source 5 to supply electromagnet coil current I. On the other hand, during a time in which the memory selection signal CHG is ON, the second memory device 9 is inoperative. Therefore, rewriting of memory content is possible by the control computer 2 through the data bus 6.

Then, when the memory selection signal CHG is OFF, clock pulses CP is output as clock signal CP2 through the clock switch circuit 7.

Therefore, the first memory device 8 does not operate and only the second memory device 9 operates upon the clock signal CP2 to provide a digital signal DO2. The digital signal DO2 is output through the output circuit 10 as a digital output signal DO by which current I is supplied to the electromagnet coil K. During the operation of the second memory device 9, the first memory device is inoperative. Therefore, rewriting of the content of the first memory device 8 is possible by the control computer 2 through the data bus 6.

In this manner, the switching operation of the memory devices and the rewriting operations of the memory contents can be easily performed by using a display terminal device belonging to the control computer 2.

Thus, according to the present invention, the rewriting of memory contents becomes possible without interrupting the periodic operation and further it is possible to continue the operation with the rewritten data without difficulty.

In the described embodiment, only one electromagnet coil is used. When a plurality of electromagnet coils are used, the clock switch circuit 7, the first memory device 8, the second memory device 9 and the output circuit 10 shown in FIG. 1 are made a unit which is assigned to each of the electromagnet coil. Operations of them are the same as that in the described embodiment. It is clear that the present invention can be applied to not only electromagnets but also to devices such as RF devices which operate with a constant pattern.

In the described embodiment, the start/stop signal ST and the memory selection signal CHG each takes a binary value, ON state or OFF state. However, it is possible to use different signal lines in such a way that, for the start/stop signal ST, a start signal line and a stop signal line are used and, for the memory selection signal CHG, a first memory selection signal line and a second memory selection signal line are used so that the pulse generator 3 and the clock switch circuit 7 can be operated therethrough.

Furthermore, the output circuit 10 has, in the described embodiment, a construction by which a logical sum of a plurality of inputs are output. However, the present invention can be realized by using an output signal switch circuit which only a side on which signals are input is selected by using a memory selection signal CHG and outputs them.

Furthermore, the embodiment has been described with respect to the case where the digital signals DO1, DO2 are used as the digital output signal DO to process a digital signal of parallel 16 bits. However, this signal is not always 16 bits and any bit number can be used depending upon a request of the power source. Furthermore, it is also applicable to serial digital signals rather than parallel signals.

In the described embodiment, two memory devices, the first memory device 8 and the second memory device 9, are used and only one of them is selectively operated such that the memory content rewriting is performed in the inoperative memory device and that the rewritten memory device can be switched in the periodic operation without interruption. However, it is possible to prepare three sets of memory devices or more and to use them cyclically. For example, when four sets of such memory devices are prepared, it is possible to have a time corresponding to three periods as the memory content rewriting time for one memory device. That is, in general, by preparing n sets of memory devices, it is possible to have a time corresponding to (n−1) periods as the memory content rewriting time for one memory device.

Figure 8:
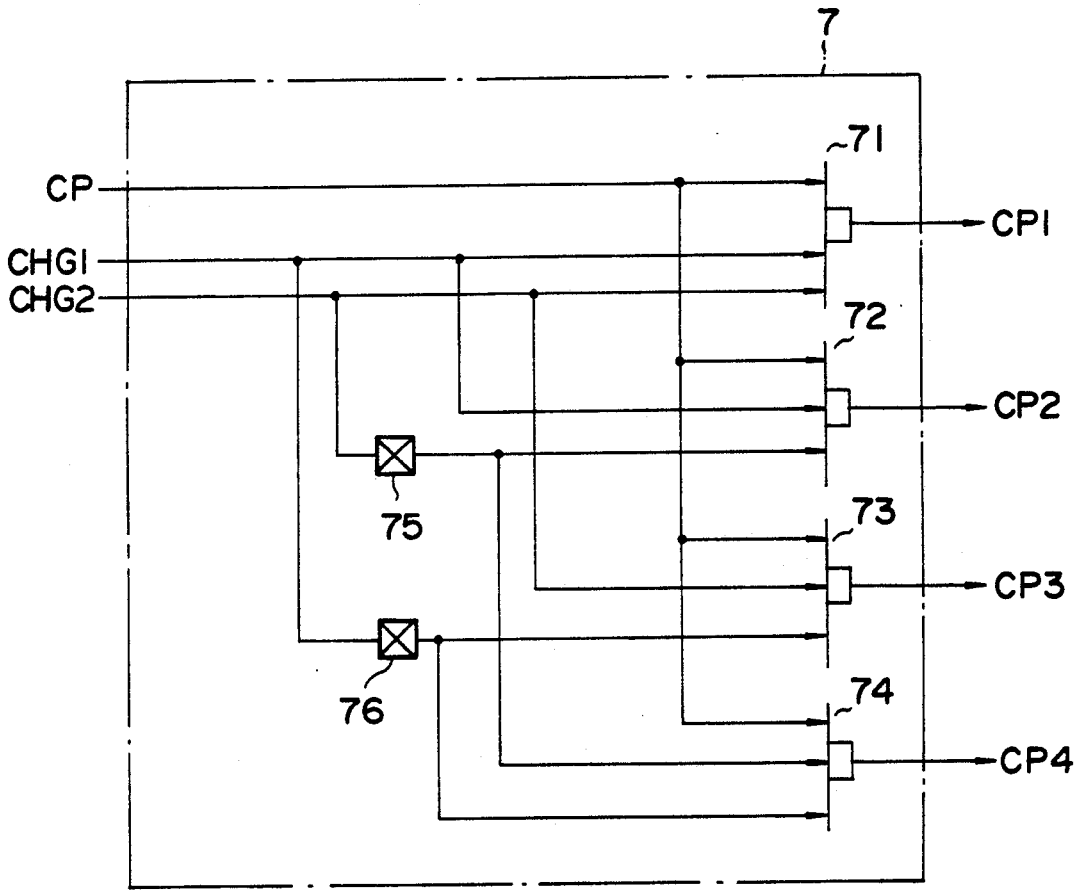
FIG. 8 shows the clock switch circuit in detail when four memory devices are provided.

FIG. 8 shows a construction of a clock switch circuit for the case where four sets of memory devices are provided. The clock switch circuit 7 includes four 3-input logical product elements 71, 72, 73 and 74 for outputting respective clock signals CP1, CP2, CP3 and CP4 to the four sets of memory devices. The clock pulses CP is supplied to first inputs of the respective logical product elements 71, 72, 73 and 74. Memory selection signals CHG1 and CHG2 are supplied to second and third inputs of the respective logical product elements directly or through an inversion circuit 75 or 76. That is, the memory selection signals CHG1 and CHG2 are supplied to the second and the third inputs of the element 71 directly, the memory selection signal CHG1 is supplied to the second input of the element 72 directly and the memory selection signal CHG2 is supplied to the third input thereof through the inversion circuit 75, the memory selection signal CHG2 is supplied to the second input of the element 73 directly and the memory selection signal CHG1 is supplied to the third input thereof through the inversion circuit 76, and the memory selection signals CHG1 and CHG2 are supplied to the second and the third inputs of the element 74 through the inversion circuits 75 and 76, respectively.

With this logic circuit, it is possible to selectively output the clock signal CP1, CP2, CP3 or CP4 as follows:

If CHG1="1" and CHG2="1", then CP1 is output.
If CHG1="1" and CHG2="0", then CP2 is output.
If CHG1="0" and CHG2="1", then CP3 is output.
If CHG1="0" and CHG2="0", then CP4 is output.

What is claimed is:

1. A control device of a particle accelerator, said accelerator having at least one particle accelerator coil, said control device comprising, a power source for supplying current to said coil;

a pulse generator for producing clock pulses;

a plurality of memory means for storing time variation of current flowing through said coil as an operation pattern;

means for reading said operation pattern stored in the selected one of said plurality of memory means in synchronism with said clock pulses from said pulse generator;

an output circuit for supplying said operation pattern read out by said reading means to said power source; and means for rewriting an operation pattern to be stored in said memory means to which no clock pulses are supplied.

2. The control device claimed in claim 1, further comprising a switch means for selectively supplying said clock pulses from said pulse generator to one of said plurality of memory means.

3. The control device claimed in claim 2, wherein said switch means supplies said clock pulses cyclically to each of said plurality of memory means with a predetermined sequence, respectively.

4. The control device claimed in claim 1, wherein said output circuit comprises logical sum circuits connected to each of said plurality of memory means.

5. The control device claimed in claim 2, further comprising a control computer for controlling said pulse generator, said switch means and said plurality of memory means.

6. The control device claimed in claim 2, wherein said switch means comprises switch elements connected in series with an input of each of said plurality of memory means and means for cyclically turning on said switch elements in a predetermined sequence.

* * * * *